US007310901B1

(12) United States Patent
Estes

(10) Patent No.: US 7,310,901 B1
(45) Date of Patent: Dec. 25, 2007

(54) EXTERIOR ADDRESS PORCH LIGHT

(76) Inventor: Johnny L. Estes, 3794 SE. 174th Ct., Ocklawaha, FL (US) 32179

( * ) Notice: Subject to any disclaimer, the term of this patent is extended or adjusted under 35 U.S.C. 154(b) by 0 days.

(21) Appl. No.: 11/348,033

(22) Filed: Feb. 6, 2006

(51) Int. Cl.
*G09F 13/00* (2006.01)

(52) U.S. Cl. ..... 40/580; 40/564; 40/576

(58) Field of Classification Search ..... 40/564, 40/576, 579, 580, 557; 362/145, 362
See application file for complete search history.

(56) References Cited

U.S. PATENT DOCUMENTS

| | | | | | |
|---|---|---|---|---|---|
| 738,569 | A * | 9/1903 | Penfield | 40/502 |
| 1,114,834 | A * | 10/1914 | Wight | 40/580 |
| 1,180,138 | A * | 4/1916 | Giese | 40/553 |
| 1,642,644 | A * | 9/1927 | Clemons | 40/553 |
| 1,663,386 | A * | 3/1928 | Rice | 40/564 |
| 1,668,799 | A | 5/1928 | Bergan | |
| 2,118,469 | A * | 5/1938 | Lorbetske | 40/576 |
| D118,738 | S | 1/1940 | Herring | |
| 2,245,885 | A * | 6/1941 | Webster | 40/575 |
| 2,798,323 | A * | 7/1957 | Witz | 40/576 |
| 3,587,185 | A * | 6/1971 | Deal | 40/564 |
| 4,611,265 | A | 9/1986 | Davis | 362/145 |
| 4,765,080 | A * | 8/1988 | Conti | 40/576 |
| 4,841,416 | A * | 6/1989 | Doss | 362/183 |
| 4,937,499 | A | 6/1990 | Hunte | 315/149 |
| 4,953,067 | A * | 8/1990 | Moore | 362/431 |
| 5,025,355 | A | 6/1991 | Harwood | 362/147 |
| 5,729,924 | A | 3/1998 | Reading | 40/564 |
| 5,797,673 | A | 8/1998 | Logan et al. | 362/234 |
| 5,832,642 | A | 11/1998 | Dalton | 40/546 |
| 5,911,524 | A | 6/1999 | Wilton | 40/574 |
| 6,341,441 | B1 * | 1/2002 | Morales | 40/564 |
| 6,401,373 | B1 * | 6/2002 | Sexton | 40/576 |
| 6,629,766 | B2 | 10/2003 | Cathel | 362/372 |
| 6,658,774 | B1 | 12/2003 | Munter et al. | 40/574 |
| 6,745,507 | B2 | 6/2004 | Golding | 40/564 |
| 6,799,716 | B1 * | 10/2004 | Kuelbs | 232/39 |

* cited by examiner

*Primary Examiner*—Gary C. Hoge
(74) *Attorney, Agent, or Firm*—Brian S. Steinberger; Law Offices of Brian S. Steinberger, P.A.

(57) ABSTRACT

An exterior address porch light, lantern, device, apparatus, and method of making the light, lantern. The light, lantern can be made from plastics, such as PVC and the like, and have a generally cylindrical configuration, that can be mounted alongside exterior doorways, and the like, where existing porch light type lanterns are located. The light, lantern can be solar powered, and/or battery powered, and/or adapted for 120 volt building power supplies. The top of the lantern, light can have a solar cell on a cap cover which overhangs a vertically oriented PVC pipe shaped type housing. Inside the light, lantern can be a light source such as a bulb, and the like. Across the front exterior face can be a rectangular cut-out portion with lettering and/or numbering that can be illuminated from the light source. On the bottom of the pipe housing can be a bottom cap with a row of through-holes where light from the light source can be emitted therefrom, and be directed toward, door knobs, door bells, the entranceway to the exterior doorway, and the like. A light sensor can turn on the light source automatically at dusk, during night-time, and/or during poor weather conditions.

10 Claims, 11 Drawing Sheets

EXTERIOR ADDRESS PORCH LIGHT

This invention relates to lights, in particular to devices, apparatus and methods of making an exterior address porch light.

BACKGROUND AND PRIOR ART

Lamps and lights are highly desirable for being mounted adjacent to front doors to homes and businesses which are spaced away from building addresses. Traditional lamps and lights usually include a lantern mounted by and separated from the exterior of the building by an arm. Other types of popular lights have included lanterns, and the like that are suspended by rods, wires, chains, and the like. While popular and traditional, these lights and lanterns do not directly illuminate the building addresses. Thus, during night-time conditions and during bad weather, a building address is not clearly readable by traditional and popular hanging and mounted lights and lanterns.

Attempts have been made to try to illuminate addresses with a hanging lamp. See for example, U.S. Pat. No. Des. 118,738 to Herring. However, such as hanging light would have other readable problems since the light must be hung quite high above a doorway so that pedestrian traffic does not knock into the hanging light. Additionally, the Herring lamp does not work when there is not an overhang above the doorway on which to mount the hanging light.

Various types of lighted address signs have also been proposed over the years. See for example, U.S. Pat. Nos. 1,668,799 to Bergan; 4,611,265 to Davis; 4,937,499 to Hunte; 5,025,355 to Harwood; 5,729,924 to Reading; 5,797,673 to Logan et al.; 5,911,524 to Wilton; 5,832,642 to Dalton; 6,629,766 to Cathel, 6,658,774 to Munter et al.; and 6,745,507 to Golding.

However, these signs generally illuminate the building address numbers, but fail to illuminate a doorway. Thus, these address signs fail to function as porch lights. Additionally, these address signs are not aesthetically pleasing and instead are no more than generally unattractive rectangular type boxes. These box sings must also require separate mounting hardware for mounting somewhere around the front wall of the building. Often there is not much space to mount such signs. Additionally, these illuminated box signs would require additional electrical hook ups that add to their expense and further undesirability.

Thus, the need exists for solutions to the above problems with the prior art.

SUMMARY OF THE INVENTION

A primary objective of the present invention is to provide porch light, lantern apparatus, device, and method of making the light that doubles as both a light for an exterior doorway and an address illuminator.

A secondary objective of the present invention is to provide an exterior address porch light, lantern apparatus, device, and method of making the light that is able to mount next to any exterior door.

A third objective of the present invention is to provide an exterior address porch light, lantern apparatus, device, and method of making the light that can use the same power supply as an existing porch light, and does not need additional electrical wiring.

A fourth objective of the present invention is to provide an exterior address porch light, lantern apparatus, device, and method of making the light that can be battery powered.

A fifth objective of the present invention is to provide an exterior address porch light, lantern apparatus, device, and method of making the light that can be solar powered.

A sixth objective of the present invention is to provide an exterior address porch light, lantern apparatus, device, and method of making the light, that can be automatically be activated at dusk and/or during the night and/or during poor weather conditions.

A seventh objective of the present invention is to provide an exterior address porch light, lantern apparatus, device, and method of making the light that can be formed from plastic, such as PVC, and the like.

An eighth objective of the present invention is to provide an exterior address porch light, lantern apparatus, device, and method of making the light that is aesthetically attractive.

A ninth objective of the present invention is to provide an exterior address porch light, lantern apparatus, device, and method of making the light, where the address numbers and/or letters can be easily changed.

A tenth objective of the present invention is to provide an exterior address porch light, lantern apparatus, device, and method of making the light, having easily readable address letters and/or numbers.

An eleventh objective of the present invention is to provide an exterior address porch light, lantern apparatus, device, and method of making the light, that can be easily assembled, mounted and installed.

A preferred embodiment of the exterior address porch light can include a cylindrical housing having an upper end and a bottom end, address symbols across a vertical face of the cylindrical housing, and a light source for illuminating the address symbols, wherein the light can be mounted adjacent to an exterior doorway and double as both an illuminator for the exterior doorway and as the address identifier for the doorway.

A battery power source can be used for providing electrical power to the light source. Additionally, or alternatively, a 120 volt power source can be used for providing electrical power to the light source that is hardwired to a building on which the light can be mounted. Additionally or alternatively a solar power source can be used for providing electrical power to the light source.

An upper cap cover can be used for covering the upper end of the cylindrical housing, the cap cover having an upper surface for a solar cell, and the cap cover having overhanging edges that form an overhanging rim extending over sides of the cylindrical housing.

A bottom cap cover can be used for covering the lower end of the cylindrical housing, the bottom cap cover, having at least one through-hole, wherein light from the light source emits therefrom. The bottom cap can include one or more, such as a row of through-holes, wherein the light from the light source emits therefrom.

The cylindrical housing and/or the top and/or bottom cap covers can be made from PVC, material, and the like.

A novel method of making a doorway address light can include the steps of cutting out a side opening through a face surface of a pipe, such as a plastic pipe, PVC, pipe, and the like. Next, a light source such as a bulb and socket can be fastened to an inside portion of the pipe. Address symbols such as lettering and numbering that allows light to pass therethrough can cover the side cut-out opening of the pipe. The pipe can be mounted in a vertical orientation next to a doorway. Activating the light source at dusk, night, during poor weather by an optical/light sensor causes the light to illuminate the address indicia. Additionally, through-hole(s)

along a bottom portion of the pipe, such as in a bottom cap cover, can also allow light to be emitted therefrom adding illumination to the doorway, and/or a door knob and/or to a door lock and/or to a door bell, etc.

Power for the light can be by a battery pre-charged by a solar cell/panel, the latter of which can be on the top of the vertically oriented pipe. Additionally or alternatively, power can come from a 120 volt power supply, and the like. The light can also be in an on position during the day for further address illumination, and the like.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The components will now be described.

Figure 1:
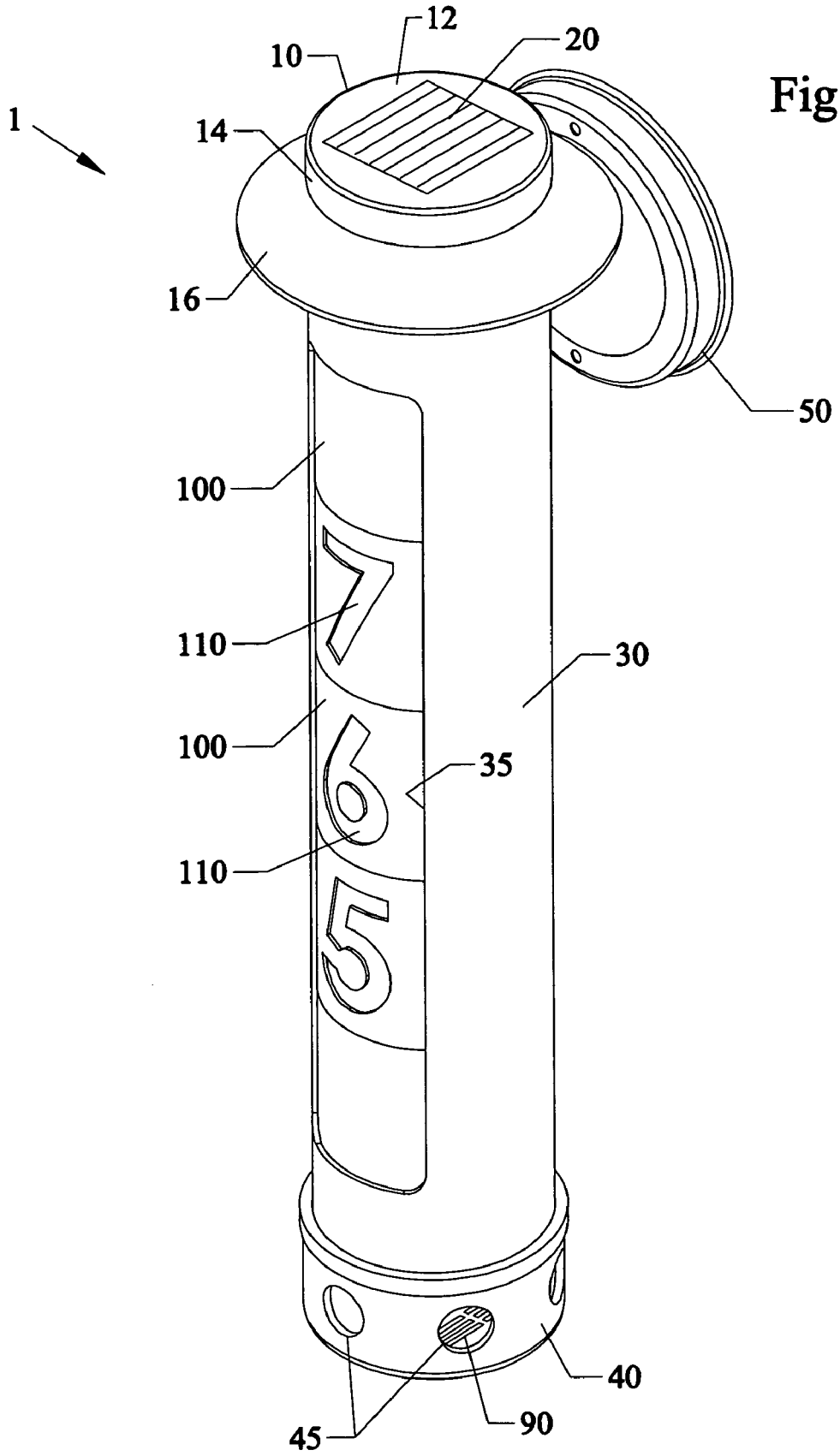
FIG. 1 is a right perspective front view of a preferred embodiment of the exterior address porch light.
Figure 2:
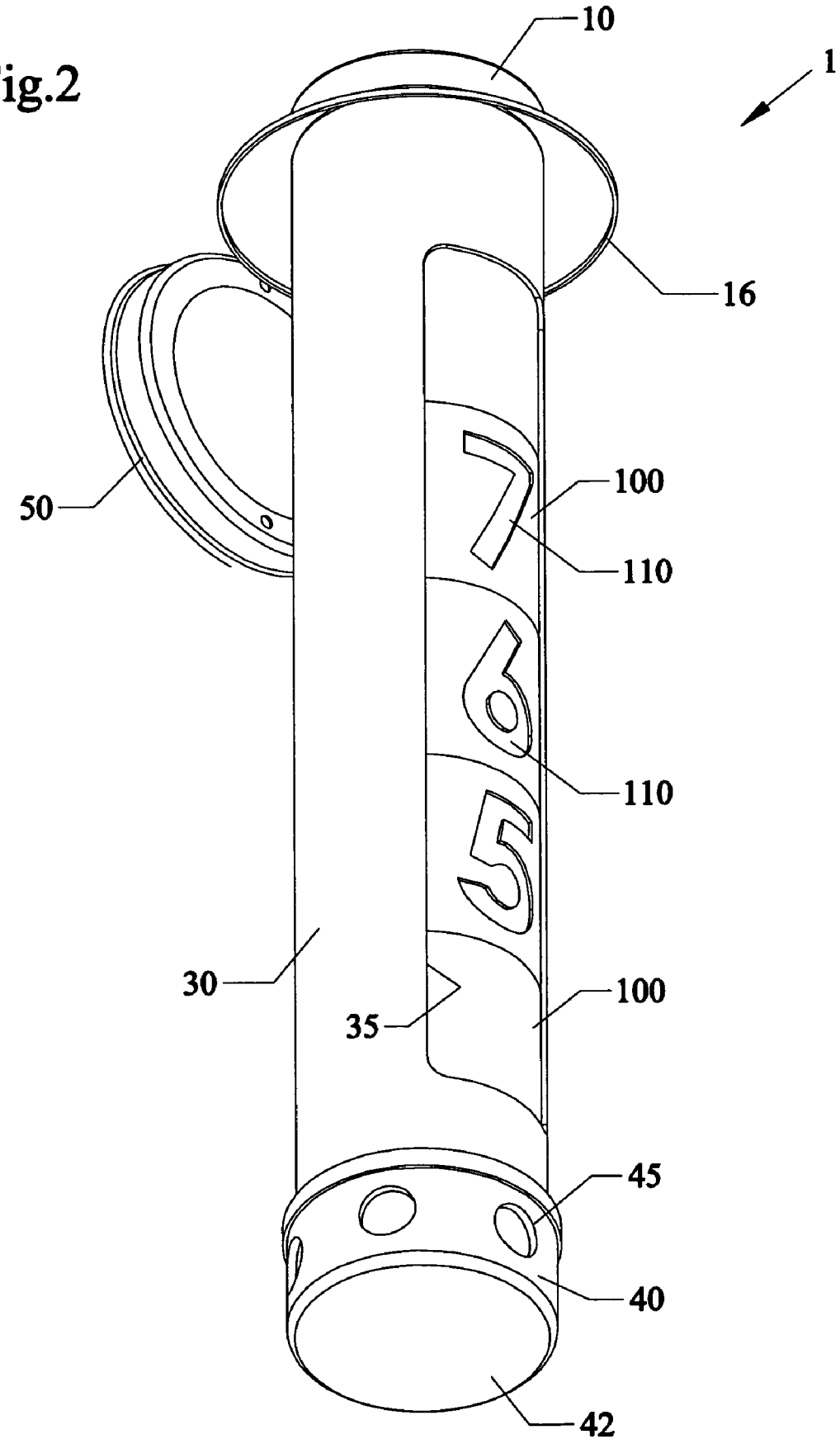
FIG. 2 is left perspective front view of a preferred embodiment of the exterior address porch light of FIG. 1.
Figure 3:
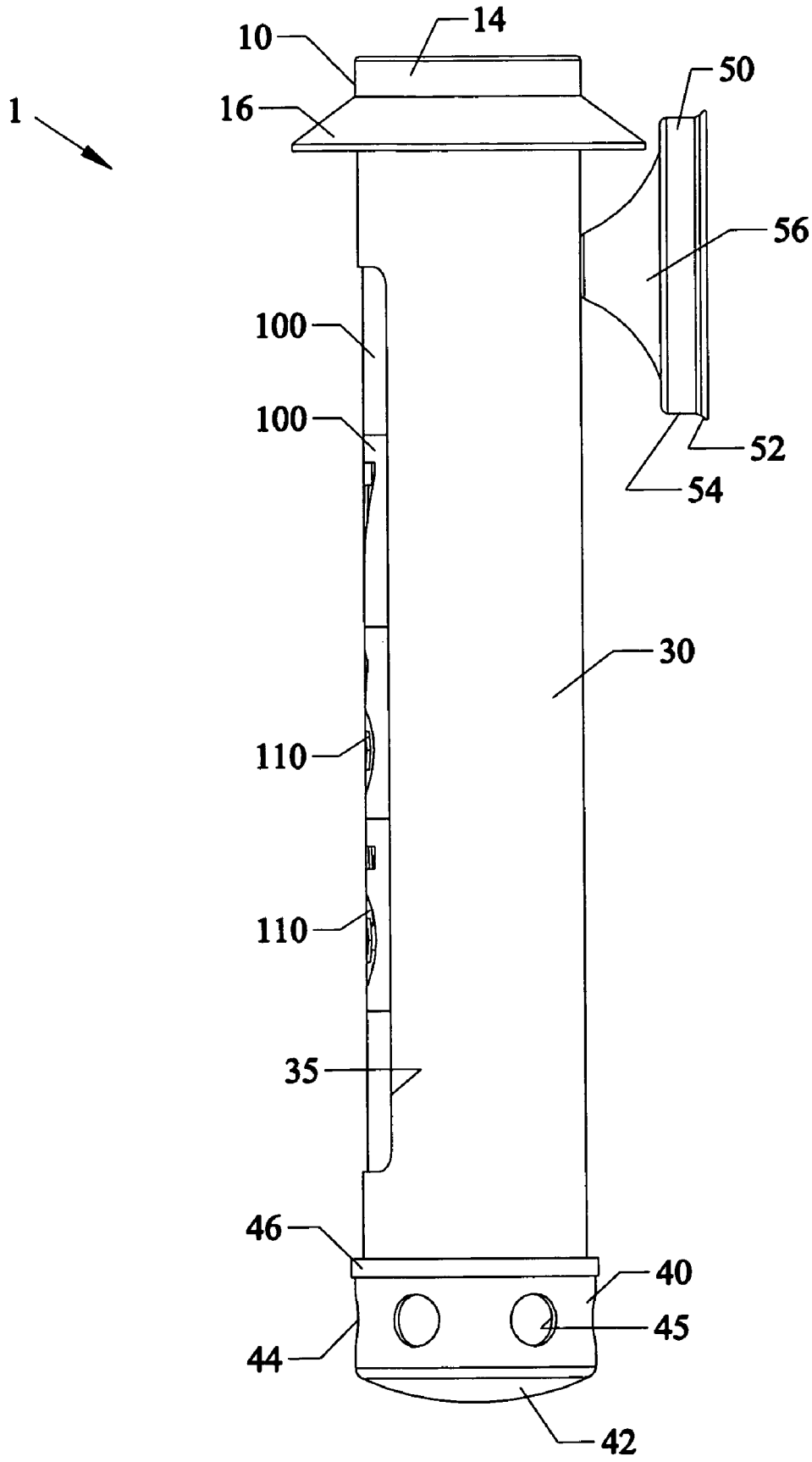
FIG. 3 is a right side view of the exterior address porch light of the preceding figures.
Figure 4:
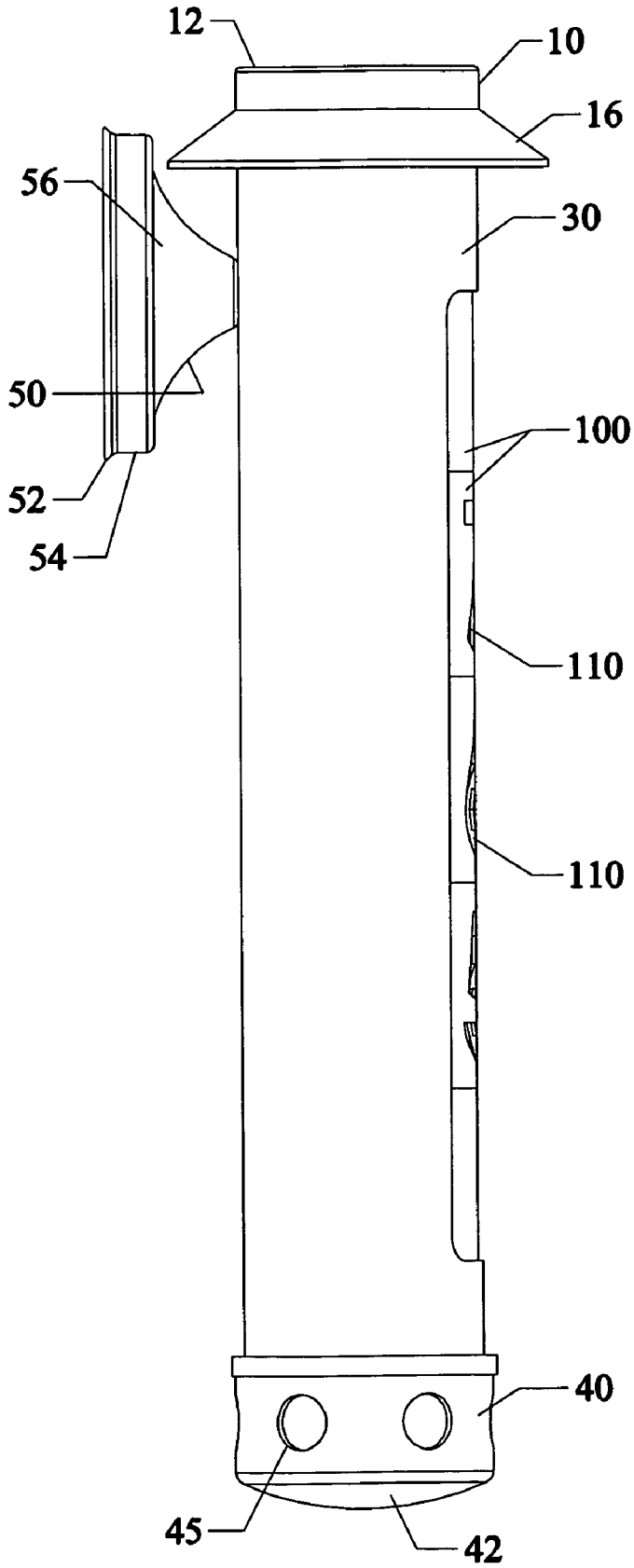
FIG. 4 is a left side view of the exterior address porch light of the preceding figures.
Figure 5:
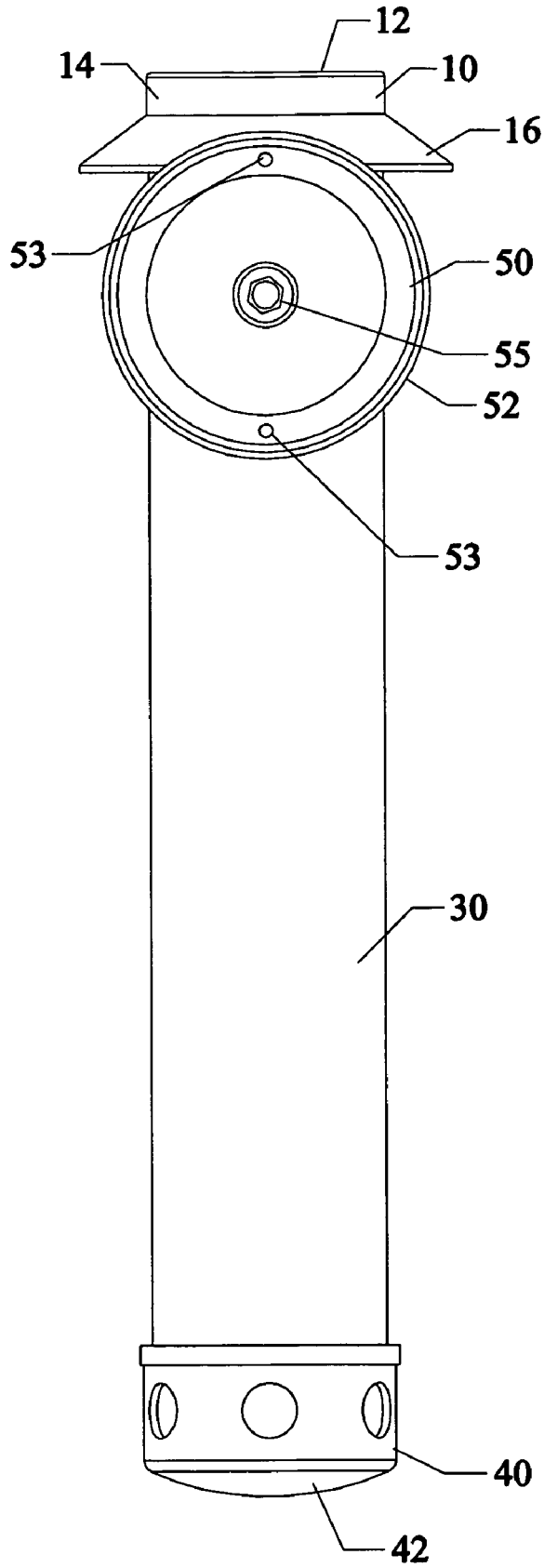
FIG. 5 is a rear side view of the exterior address porch light of the preceding figures.
Figure 6:
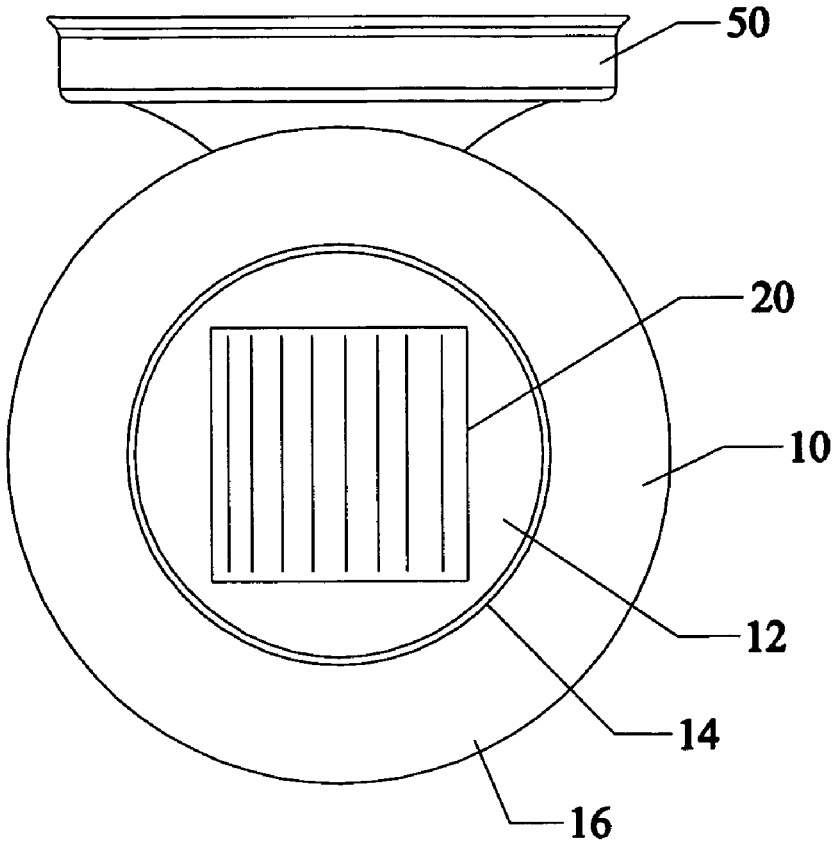
FIG. 6 is a top view of the exterior address porch light of the preceding figures.
Figure 7:
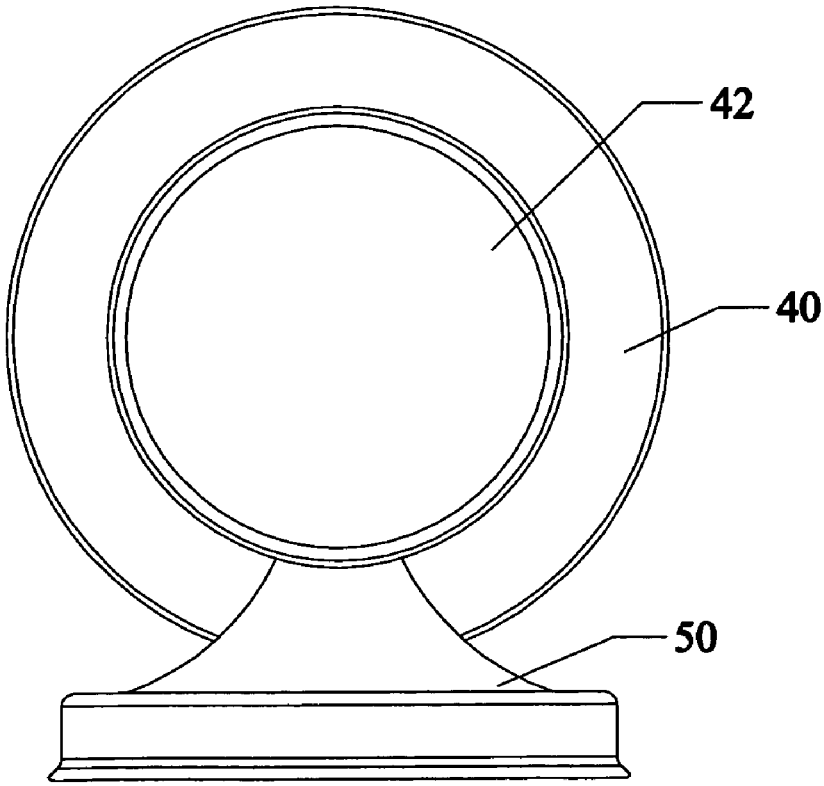
FIG. 7 is a bottom view of the exterior address porch light of the preceding figures.

10 Top cap
12 upper flat surface
14 cylindrical ring
16 downwardly sloping side edges(overhanging roof portion)
20 solar panel/cell
30 cylindrical pipe/tube housing
35 rectangular cut-out across face
40 Bottom cap
42 bottom surface of bottom cap
44 sides of bottom cap
46 raised edge of bottom cap
45 row of through-holes in bottom cap
50 wall mount
52 raised rear edge
54 ring about raised rear edge
56 cone shaped member
53 through-holes in cone shaped member
55 screw/bolt and nut
60 light source(bulb in socket)
70 battery power source
80 wall plug adapter
90 optical/light sensor
100 address symbol surface member/portion
110 letters/numbers
200 wall on which mount is attached
300 doorway/entranceway FIG. 1 is a right perspective front view of a preferred embodiment of the exterior address porch light 1. FIG. 2 is left perspective front view of a preferred embodiment of the exterior address porch light 1 of FIG. 1. FIG. 3 is a right side view of the exterior address porch light 1 of the preceding figures. FIG. 4 is a left side view of the exterior address porch light 1 of the preceding figures. FIG. 5 is a rear side view of the exterior of the preceding figures. FIG. 6 is a top view of the exterior address porch light 1 of the preceding figures. FIG. 7 is a bottom side view of the exterior address porch light 1 of the preceding figures.

Figure 8:
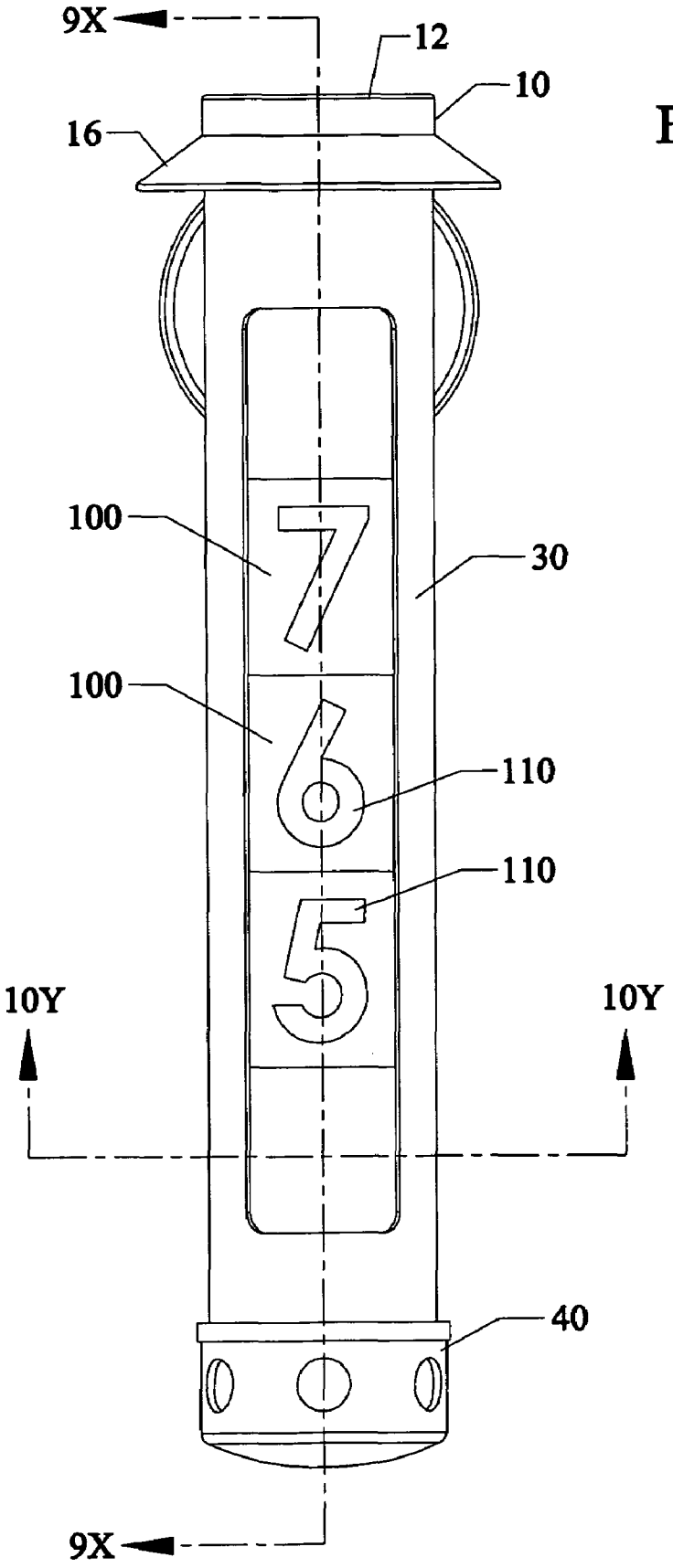
FIG. 8 is a front side view of the exterior address porch light of the preceding figures.
Figure 9:
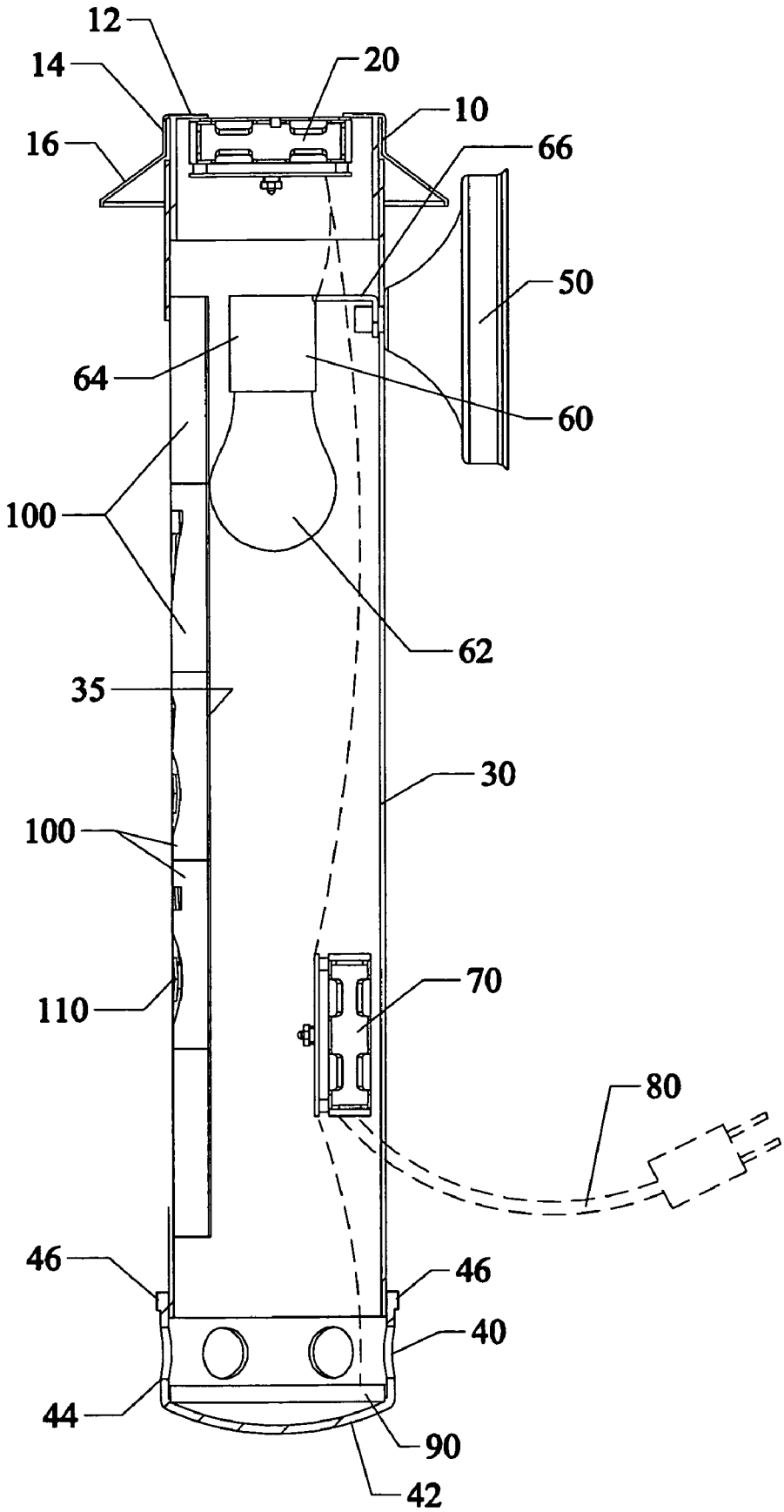
FIG. 9 is a longitudinal cross-sectional view of the light of FIG. 8 along arrows 9X.
Figure 10:
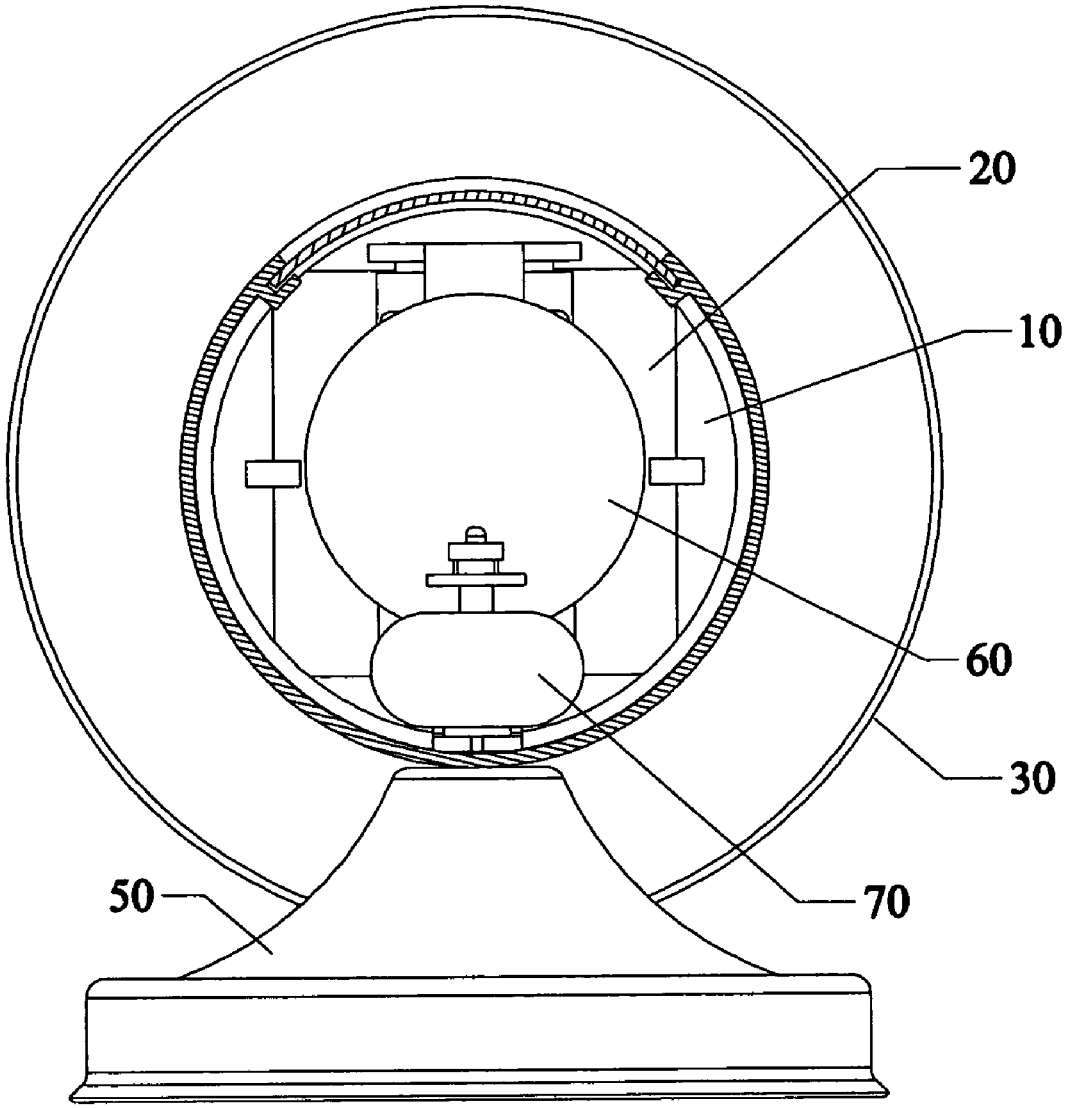
FIG. 10 is an upper cross-sectional view of the light of FIG. 8 along arrows 10Y.
Figure 11:
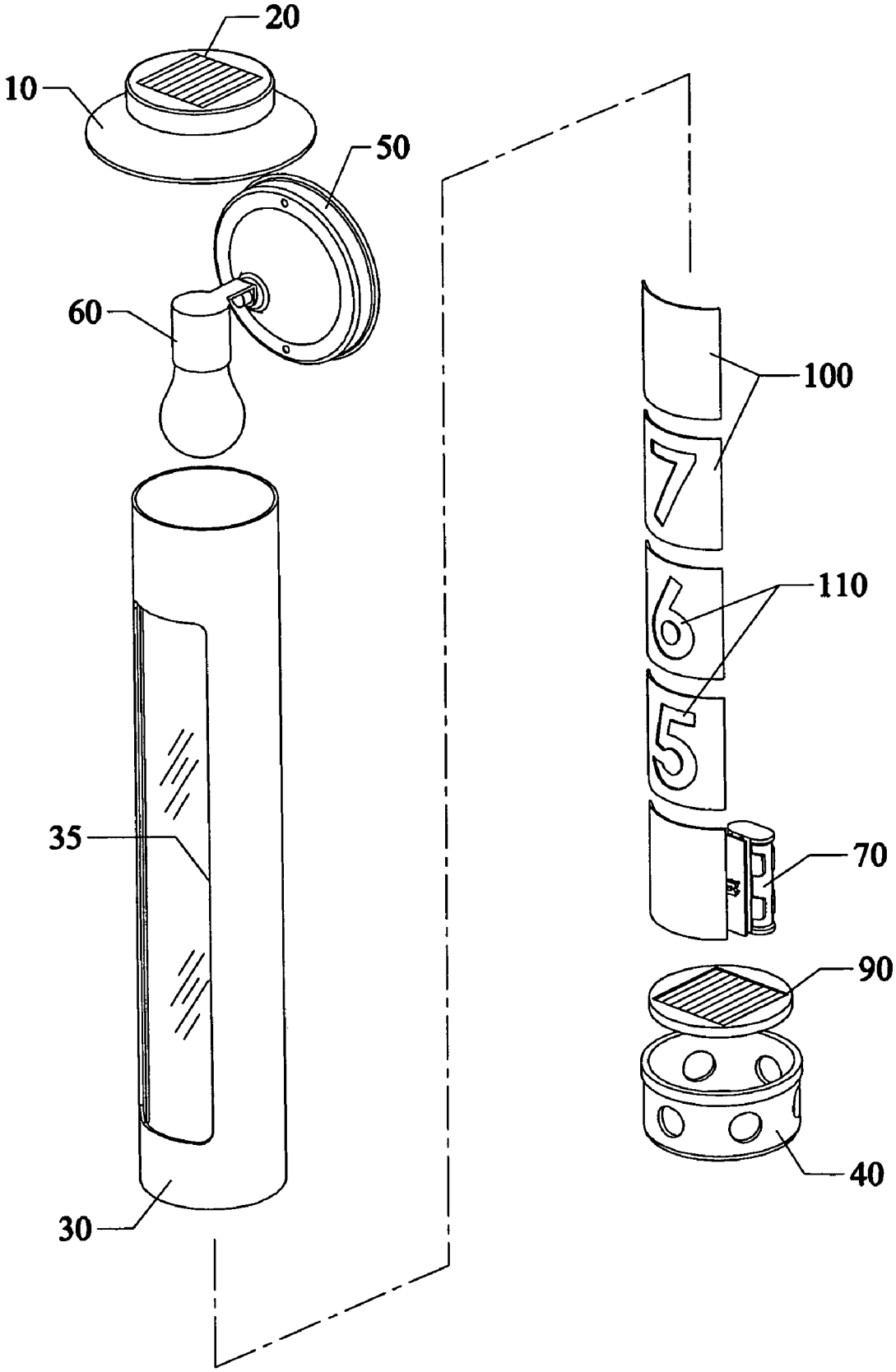
FIG. 11 is an exploded view of the components of the light of the preceding figures.

FIG. 8 is a front side view of the exterior address porch light 1 of the preceding figures. FIG. 9 is a longitudinal cross-sectional view of the light 1 of FIG. 8 along arrows 9X. FIG. 10 is an upper cross-sectional view of the light 1 of FIG. 8 along arrows 10Y. FIG. 11 is an exploded view of the components of the light 1 of the preceding figures.

Referring to FIGS. 1-11, the exterior address porch light can be formed from a cylindrical pipe/tube housing 30 such as a hollow PVC pipe, and the like. Along one exterior side face of the cylindrical housing 30 can be a rectangular cut-out opening 35. Address indicial surface portion 100 such as see-through plastic sheeting, plastic film, and the like, having indicia 110 such as letters and/or numbers thereon. The lettering/numbering indicia 110 can be see-through and the surrounding material 100 being opaque so that light only passes through the lettering/numbering indicia 110. Coloring such as red, yellow, green, blue, white, black, orange, and any variation thereof can be used for the lettering/numbering and/or the surrounding material. Other types of indicia can also be used, such as cut-outs for some of all of the letters/numbers, and the like. While a rectangular cut-out 35 is shown, the cut-out and/or opening in the side of the cylindrical housing 30 can have other shapes, such as but not limited to oval, square, triangular, and any other variations, thereof.

At the upper end of the cylindrical housing 30 can be a top cap 10 having an upper generally flat surface 12, cylindrical ring portion 14, and downwardly sloping side edges 16 which can overhang and extend outward beyond the sides of the cylindrical housing 30, and function as an overhanging roof portion. The top cap 10 can be attached by mateable threads to be screwed on, and/or affixed in place with cement, and the like, to the top open end of the cylindrical housing 30. Imbedded in the flat surface 12 can be solar cell/panel 20, the function of which will be described later on.

At the bottom/lower end of the cylindrical housing 30 can be a bottom cap 40 with a closed bottom surface 42 that can be flat and/or curved such as convex or concave. Along the sides 44 of the bottom cap 40 can be a row or series of through-holes 45 therethrough that allow light from inside the cylindrical housing 30 to be emitted therefrom. Around an upper portion of the bottom cap cover 40 can be raised ridge area 46. The bottom cap 40 can be attached by mateable threads to be screwed on, and/or affixed in place with cement, and the like, to the open bottom end of the cylindrical housing 30. Inside of the bottom cap cover can be an optical/light sensor 90 that can be connected to the inside battery power source 70 and light source 60.

The cylindrical housing 30 can be mounted to a wall by a wall mount 50, which can have a cone shaped member mid portion 56 with the expanded end having a raised rear edge 52 that can abut to the wall on which the light 1 is attached, and a ring 54 about the raised rear edge 54. The narrow end of the cone shaped member 56 can be attached to a rear side of the cylindrical housing 30 by bolt/screw and nut combo 55. The wall mount can be fastened to a wall by screws/bolts, and the like(not shown) by through-holes 53 in the cone shaped member 56.

A light source 60 such as but not limited to a bulb 62, that can be colored(yellow and the like), can be threaded into a socket 64 inside of the cylindrical housing 30 and aimed downward, which can be attached to the nut/screw and nut combo 55 of the wall mount 50 by a bracket 66. The solar cell/panel 20 can charge the battery 70, with the optical/light sensor 90 activating the light source 60 at dusk, during the night and/or during poor weather conditions. Alternatively, the light source 60 can remain on during daytime hours for create further illumination of the address indicia 110. Additionally, the light source 60 and/or battery 70 can be powered by existing hardwired power source 80 such as a 120 volt power supply coming from the building/wall the light 1 is mounted on.

Figure 12:
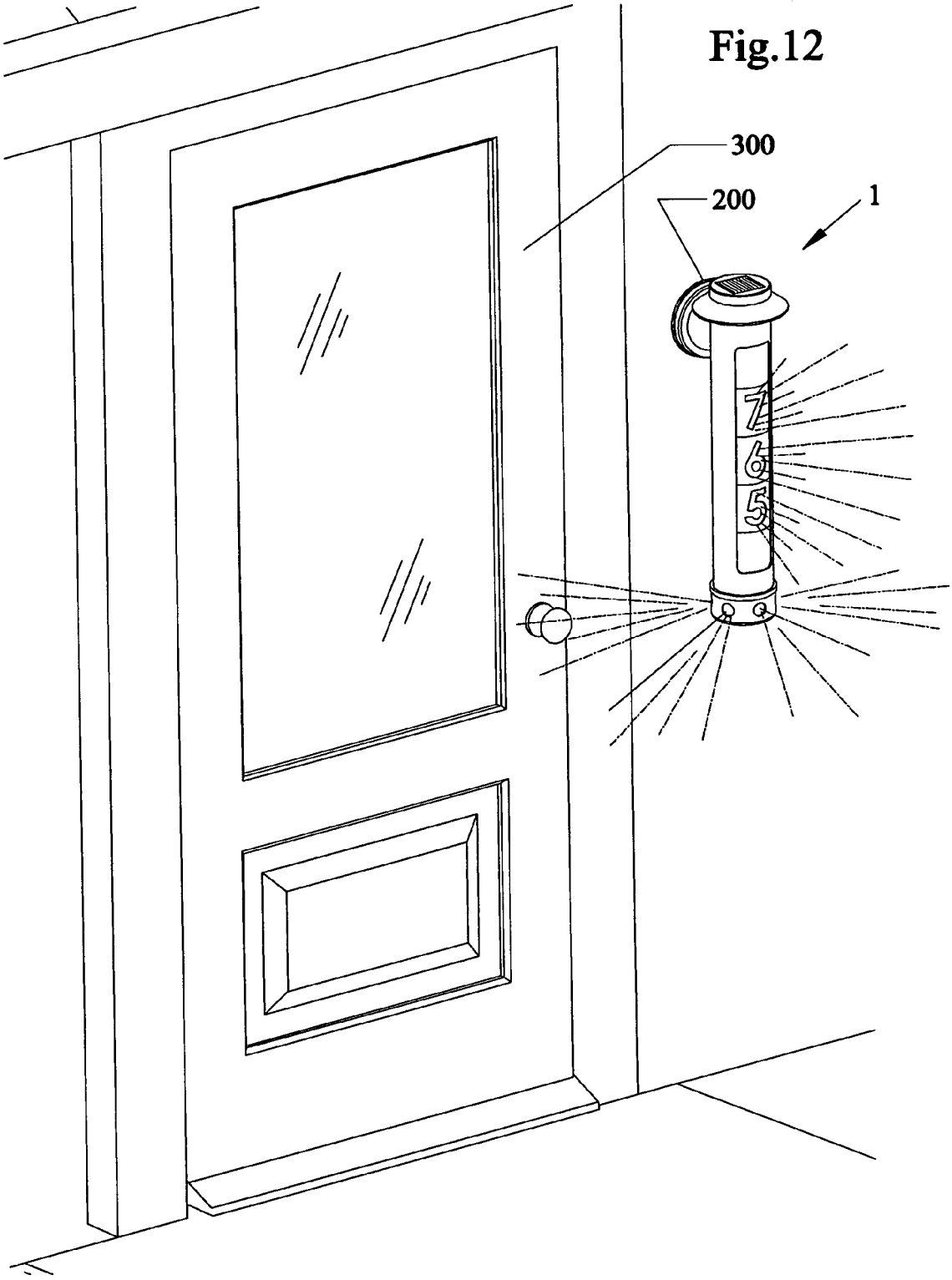
FIG. 12 shows the address porch light of preceding figures mounted next to a doorway.

FIG. 12 shows the address porch light 1 of preceding figures mounted on a wall 200 next to a doorway 300, such as an exterior door, doorway, and the like. As shown, the address symbols such as lettering and numbering allow for the light to pass therethrough. The pipe can be mounted in a vertical orientation next to a doorway to hang down and spaced away from the wall 200. Activating the light source at dusk, night, during poor weather by an optical/light sensor causes the light to illuminate the address indicia. Additionally, through-hole(s) along a bottom portion of the pipe, such as in a bottom cap cover, can also allow light to be emitted therefrom adding illumination to the doorway, and/or to a door knob and/or to a door lock and/or to a door bell, etc.

The invention can be sold in kit form and assembled by the user using the various steps of assembly. Steps can include cutting out a side opening through a face surface of a pipe, such as a plastic pipe, PVC, pipe, and the like. Next, a light source such as a bulb and socket can be fastened to an inside portion of the shape. Address symbols such as lettering and numbering that allows light to pass therethrough can cover the side cut-out opening of the pipe. The pipe can be mounted in a vertical orientation next to a doorway. Activating the light source at dusk, night, during poor weather by an optical/light sensor causes the light to illuminate the address indicia. Additionally, through-hole(s) along a bottom portion of the pipe, such as in a bottom cap cover, can also allow light to be emitted therefrom adding illumination to the doorway, and/or to a door knob and/or to a door lock and/or to a door bell, etc. The kit form can include pre-cut out openings, and the like, as well.

The bottom of the cylindrical housing(pipe) can also include an different location for the existing solar panel/cell or an additional solar cell/panel that can also be used for charging the battery and/or for operating the light source. This additional solar cell/panel can be located just inside of the through-hole(s) in the bottom end, so that light can pass through the through-holes to the solar cell/panel.

While PVC type plastic is referenced, the invention can be made from different materials, such as but not limited to metal, aluminum, galvanized metal, and the like, that can also be painted and/or coated with different color(s) as needed.

Although the preferred embodiment references use of the invention as an exterior address porch type light, the invention can be used to illuminate entranceways, such as apartments, condominiums, classrooms, offices, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An exterior address porch light, comprising:

a cylindrical housing formed from a PVC pipe having an upper open end and a bottom open end;

address symbols across a vertical face of the cylindrical housing; and a light source for illuminating the address symbols;

a battery for supplying power to the light source;

an upper cap for covering the upper open end of the cylindrical housing, the upper cap having an upper surface, and downwardly sloping side edges which overhang and extend outward beyond side faces of the cylindrical housing, the downwardly sloping side edges being used as a protective roof for the light;

a solar cell in the upper surface of the upper cap for receiving light to recharge the battery during daylight hours, wherein the light is mounted adjacent to an exterior doorway and doubles as both an illuminator for the exterior doorway and as the address identifier for the doorway; and a bottom cap cover for covering the bottom open end of the cylindrical housing, the bottom cap cover having a bottom surface and side walls, the side walls having at least one through-hole, wherein light from the light source emits therefrom.

2. The exterior address porch light of claim 1, further comprising:

an 120 volt power source for providing electrical power to the light source that is hardwired to a building on which the light can be mounted, wherein the light source is powered by the 120 volt power source when the light source is not powered by the battery.

3. The exterior address porch light of claim 1, wherein the bottom cap cover includes:

a row of through-holes through the side walls, wherein the light from the light source emits therefrom.

4. The exterior address porch light of claim 1, further comprising: a light sensor for activating the light source during dark conditions.

5. The exterior address porch light of claim 1, further comprising: a cone shaped mount for mounting the cylindrical housing in a vertical orientation.

6. The exterior address porch light of claim 5, further comprising:

a socket inside an upper portion of the cylindrical housing, the socket being directly attached to an apex of the cone shaped mount, the socket being faced downward in the housing; and a bulb inside of the socket and aimed downward through the cylindrical housing.

7. A method of making a doorway address light comprising the steps of:

providing a PVC pipe with an open upper end and an open bottom end;

inserting a light source and a battery inside of the pipe;

providing an upper cap with a solar cell on an upper surface, to cover the open upper end of the pipe;

cutting a rectangular opening along one longitudinal face of the pipe;

positioning address symbols in the rectangular opening of the pipe;

mounting the pipe in a vertical orientation adjacent to a doorway;

powering the light source from the battery;

recharging the battery from the solar cell during daylight hours; and illuminating the address symbols with the powered light source;

forming a protective roof for the doorway address light with downwardly slopping edges which overhang and extend outward beyond side faces of the cylindrical housing;

covering the open bottom end of the pipe with a bottom cap cover, the bottom cap cover having side walls and a bottom surface; and cutting a row of plural through-holes through the side walls of the bottom cap cover, wherein the light source emits light through the plurality of the through-holes, and wherein the light source is located adjacent to an within the plurality of through-holes.

8. The method of claim 7, wherein the powering step further includes the step of: additionally powering the light source with 120 volt power supply, when the battery is not being used.

9. The method of claim 7, further comprising the cap of: activating the light source with a light sensor during dark environmental conditions.

10. An exterior address porch light, comprising:

a cylindrical housing formed from a PVC pipe having an upper open end and a bottom open end;

address symbols across a vertical face of the cylindrical housing; and a light source for illuminating the address symbols;

a battery for supplying power to the light source;

an upper cap for covering the upper open end of the cylindrical housing, the upper cap having an upper surface, and downwardly sloping side edges which overhang and extend outward beyond side faces of the cylindrical housing, the downwardly sloping side edges being used as a protective roof for the light;

a solar cell in the upper surface of the upper cap for receiving light to recharge the battery during daylight hours, wherein the light is mounted adjacent to an exterior doorway and doubles as both an illuminator for the exterior doorway and as the address identifier for the doorway; and a bottom cap cover for covering the bottom open end of the cylindrical housing, the bottom cap cover having a bottom surface and side walls, the side walls having a row of through-holes for allowing light from the light source to emit therethrough.

* * * * *